US009884217B2

(12) United States Patent
Henniger et al.

(10) Patent No.: US 9,884,217 B2
(45) Date of Patent: Feb. 6, 2018

(54) JUMP ROPE HANDLE AND METHOD OF ASSEMBLING SAME

(71) Applicant: Coulter Ventures, LLC, Columbus, OH (US)

(72) Inventors: William Henniger, Columbus, OH (US); Dylan Jones, Santa Barbara, CA (US)

(73) Assignee: Coulter Ventures, LLC, Columbus, OH (US)

( * ) Notice: Subject to any disclaimer, the term of this patent is extended or adjusted under 35 U.S.C. 154(b) by 242 days.

(21) Appl. No.: 13/623,872

(22) Filed: Sep. 20, 2012

(65) Prior Publication Data

US 2014/0080680 A1 Mar. 20, 2014

(51) Int. Cl.
*A63B 5/20* (2006.01)

(52) U.S. Cl.
CPC ..... *A63B 5/20* (2013.01); *A63B 2209/10* (2013.01); *Y10T 29/49948* (2015.01)

(58) Field of Classification Search
CPC ..... A63B 5/20; A63B 23/14; A63B 5/205; A63B 5/22
USPC ..... 482/44–46, 49, 50, 81, 82
See application file for complete search history.

(56) References Cited

U.S. PATENT DOCUMENTS 438,489 A 10/1890 Pringle
932,331 A * 8/1909 Russell et al ..... G06M 1/163 235/117 R
1,436,703 A 11/1922 Fisher
2,253,075 A 8/1941 Johnson
2,719,038 A * 9/1955 Massa ..... A63B 5/02 482/109
2,795,424 A * 6/1957 Fitzpatrick ..... A63B 5/20 446/243
3,182,999 A * 5/1965 Updaw ..... A63B 5/22 482/81
3,211,453 A * 10/1965 Williams ..... A63B 23/14 482/119

(Continued)

FOREIGN PATENT DOCUMENTS

DE 2641383 3/1978
DE 2641383 A1 * 3/1978 ..... A63B 5/20

(Continued)

*Primary Examiner* — Loan H Thanh
*Assistant Examiner* — Gary D Urbiel Goldner
(74) *Attorney, Agent, or Firm* — The Watson I.P. Group, PLC; Jovan N. Jovanovic; Vladan M. Vasiljevic

(57) ABSTRACT

An improved jump rope handle and method of assembling the same. The jump rope handle includes a head. The head includes a channel, a set hole perpendicular to the channel, and a set mechanism adjustably insertable into the set hole. The jump rope handle further includes a grip. The grip includes a cylindrical member, first and second bearings arranged along the cylindrical member, an inner bushing arranged along the cylindrical member between the first and second bearings, and a sleeve around said inner bushing, said bushing being fixedly attached to an inner surface of the grip. An end portion of the cylindrical member is fixedly attached to the head whereby the cylindrical member and the head rotate together about a same axis. The channel of the head is configured to receive a rope. The set mechanism is configured to be inserted into the set hole to secure the rope.

8 Claims, 7 Drawing Sheets

(56) References Cited

U.S. PATENT DOCUMENTS

| | | | | | |
|---|---|---|---|---|---|
| 3,402,952 | A * | 9/1968 | Nissen | A63B 5/12 | 285/277 |
| 3,481,600 | A * | 12/1969 | Rekolt | A63B 5/20 | 239/251 |
| 3,517,931 | A * | 6/1970 | Kalish | A63B 5/20 | 482/82 |
| 3,612,522 | A | 10/1971 | Ekonen | | |
| 4,101,123 | A | 7/1978 | Anthony | | |
| 4,158,457 | A * | 6/1979 | Hydro | A63B 5/20 | 482/82 |
| 4,179,119 | A | 12/1979 | Wolf | | |
| 4,201,382 | A * | 5/1980 | Wilson | A63B 5/20 | 482/110 |
| 4,248,486 | A | 2/1981 | Bradley, Jr. | | |
| 4,293,125 | A | 10/1981 | Hinds | | |
| 4,330,118 | A | 5/1982 | Race | | |
| 4,375,886 | A * | 3/1983 | Muys | A63B 5/20 | 482/82 |
| 4,529,195 | A * | 7/1985 | Stevens | A63B 5/20 | 482/1 |
| 4,593,899 | A * | 6/1986 | Miller | A63B 5/20 | 16/430 |
| 4,637,606 | A * | 1/1987 | Hunn | A63B 5/20 | 482/82 |
| 4,647,037 | A | 3/1987 | Donohue | | |
| 4,678,360 | A | 7/1987 | Miller | | |
| 4,693,469 | A * | 9/1987 | Cedar | A63B 21/0608 | 482/110 |
| 4,778,173 | A * | 10/1988 | Joutras | A63B 5/20 | 482/108 |
| 4,801,137 | A | 1/1989 | Douglas | | |
| 4,872,666 | A * | 10/1989 | Smith | A63B 5/20 | 16/428 |
| 5,054,772 | A | 10/1991 | Winston | | |
| 5,234,393 | A * | 8/1993 | Heinrich | A63B 5/20 | 482/81 |
| 5,409,330 | A | 4/1995 | Naines | | |
| 5,478,297 | A | 12/1995 | Dennis | | |
| 5,549,528 | A * | 8/1996 | Bryant | A63B 5/20 | 482/148 |
| 5,842,956 | A * | 12/1998 | Strachan | A63B 5/20 | 482/81 |
| 6,551,222 | B1 * | 4/2003 | Beaver | A63B 5/20 | 482/82 |
| 6,736,763 | B1 | 5/2004 | Hsu | | |
| 6,752,746 | B1 | 6/2004 | Winkler et al. | | |
| 7,066,866 | B1 * | 6/2006 | Mobley | A63B 1/00 | 482/40 |
| 7,156,779 | B2 * | 1/2007 | Rudell | A63B 5/20 | 482/81 |
| 7,462,140 | B1 * | 12/2008 | Lombardozzi | A63B 5/20 | 482/108 |
| 7,628,735 | B1 * | 12/2009 | Hsu | A63B 5/20 | 482/108 |
| 7,789,809 | B2 * | 9/2010 | Borth | A63B 5/20 | 482/82 |
| 7,976,438 | B1 * | 7/2011 | Hsu | A63B 5/20 | 482/81 |
| 8,043,196 | B1 * | 10/2011 | Chen | A63B 5/20 | 482/121 |
| 8,062,193 | B2 * | 11/2011 | Oesterling | A63B 5/20 | 403/329 |
| 8,075,455 | B2 * | 12/2011 | Gamboa | A63B 5/20 | 482/109 |
| 8,136,208 | B2 * | 3/2012 | Borth | A63B 5/20 | 16/428 |
| 8,142,333 | B2 * | 3/2012 | LaTour | A63B 5/20 | 482/8 |
| 8,177,658 | B1 * | 5/2012 | Johnson | A63B 53/14 | 473/297 |
| 8,684,892 | B1 * | 4/2014 | Ihli | A63B 5/20 | 482/81 |
| 2003/0148859 | A1 * | 8/2003 | Chun | A63B 5/20 | 482/82 |
| 2005/0164846 | A1 * | 7/2005 | Rudell | A63B 5/20 | 482/81 |
| 2006/0128534 | A1 * | 6/2006 | Roque | A63B 15/00 | 482/82 |
| 2007/0191195 | A1 | 8/2007 | St. George | | |
| 2007/0240535 | A1 * | 10/2007 | Thomas | B62K 21/125 | 74/551.1 |
| 2009/0062084 | A1 * | 3/2009 | Gamboa | A63B 5/20 | 482/82 |
| 2010/0035700 | A1 * | 2/2010 | Yu | A63B 53/02 | 473/288 |
| 2010/0160116 | A1 * | 6/2010 | LaTour | A63B 5/20 | 482/8 |
| 2011/0077133 | A1 * | 3/2011 | Oesterling | A63B 5/20 | 482/82 |
| 2011/0306474 | A1 * | 12/2011 | Gamboa | A63B 5/20 | 482/81 |
| 2013/0023365 | A1 * | 1/2013 | Idoni-Matthews | A63B 43/00 | 473/570 |
| 2013/0172157 | A1 * | 7/2013 | Glickstein | A63B 21/068 | 482/96 |

FOREIGN PATENT DOCUMENTS

| | | |
|---|---|---|
| DE | 2807651 | 8/1979 |
| DE | 29607995 | 9/1996 |
| FR | 10285 | 6/1909 |
| JP | 55136070 | 10/1980 |
| NL | 1004264 | 4/1998 |

* cited by examiner

JUMP ROPE HANDLE AND METHOD OF ASSEMBLING SAME

BACKGROUND

1. Field

Embodiments of the present invention relate generally to jump ropes. More particularly, embodiments of the present invention relate to an improved jump rope handle and method of assembling the same.

2. Description of the Related Art

Jump ropes have a long history and are widely used for entertainment and exercise. Typically, a jump rope includes a rope attached to two jump rope handles. A user can, while holding the jump rope handles in the user's hands, move the jump rope handles so as to cause the rope to move around the user. Whenever the rope rotates towards the user's feet, the user may jump and the rope may pass under the user's feet.

How a rope attaches to each jump rope handle varies considerably among existing ropes. In some ropes, the rope attaches to a rotating head attached to a grip portion of the jump rope handle. Such a configuration can improve the performance of the jump rope in that the rope may more freely move around the user. However, manufacture and assembly of such jump ropes may be complex. In other ropes, the length of the rope may be adjustable using a collar mechanism allowing the length of the rope to be customized for the user. However, adjustability may be time consuming and difficult.

In light of the foregoing and other shortcomings in the art, it is desirable to provide an improved jump rope handle and method of assembling the same.

BRIEF SUMMARY

It is an aspect of the invention to provide a precision rotating jump rope handle with an improved assembly.

It is a further aspect of the invention to provide flexibility with respect to a length and a type of rope of a jump rope.

According to an aspect of the invention, a jump rope handle is provided. The jump rope handle includes a head. The head includes a channel, a set hole perpendicular to the channel, and a set mechanism adjustably insertable into the set hole. The jump rope handle further includes a grip. The grip includes a cylindrical member, first and second bearings arranged along the cylindrical member, an inner bushing arranged along the cylindrical member between the first and second bearings, and a sleeve around said inner bushing, said bushing being fixedly attached to an inner surface of the grip. An end portion of the cylindrical member is fixedly attached to the head whereby the cylindrical member and the head rotate together about a same axis. The channel of the head is configured to receive a rope. The set mechanism is configured to be inserted into the set hole to secure the rope.

According to another aspect of the invention, a jump rope handle is provided. The jump rope handle may include a head. The head may include a bolt hole, a channel perpendicular to the bolt hole, a set screw hole in line with the bolt hole and perpendicular to the channel, and a set screw adjustably screwed into the set screw hole. The jump rope handle includes a grip including a shaft therein. The shaft includes a bolt, first and second bearings arranged along the bolt, an inner bushing arranged along the bolt between the first and second bearings, and a sleeve around said inner bushing, an outer surface of the sleeve being fixedly attached to an inner surface of the shaft of the grip. A threaded end of the bolt is screwed into the bolt hole of the head and attached thereto whereby the bolt and the head rotate together about a same axis. The channel of the head is configured to receive a rope. The set screw is configured to be screwed into the set screw hole to secure the rope.

According to another aspect of the invention, a method of assembling a jump rope handle may be provided. The method includes securing a sleeve inside a shaft of a grip of the jump rope handle. The sleeve is positioned around an inner bushing arranged along a bolt in between first and second bearings. The method further includes connecting the bolt to a head of the jump rope handle. The head includes a set screw hole to receive a set screw.

The foregoing and other aspects will become apparent from the following detailed description when considered in conjunction with the accompanying drawing figures.

DETAILED DESCRIPTION

Figure 1:
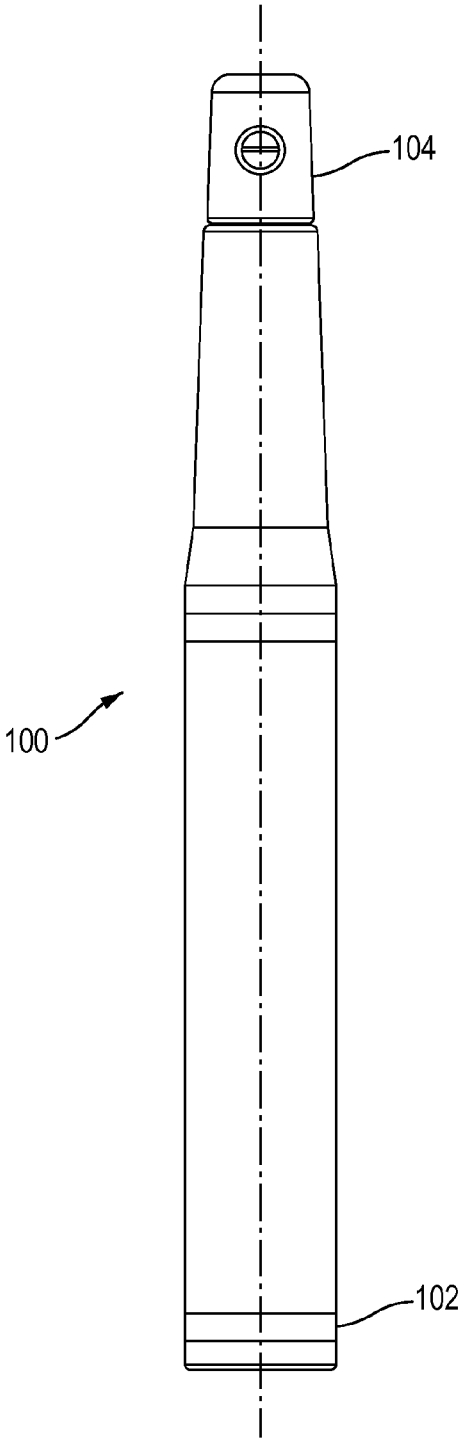
FIG. 1 is a schematic representation of a jump rope handle according to an exemplary embodiment of the invention.

Reference will now be made in detail to embodiments of the present invention, examples of which are illustrated in the accompanying drawings, wherein like reference numerals refer to the like elements throughout. The embodiments are described below to explain the present invention by referring to the figures.

As used in the description of this application, the terms "a", "an" and "the" may refer to one or more than one of an element (e.g., item or act). Similarly, a particular quantity of an element may be described or shown while the actual quantity of the element may differ. The terms "and" and "or" may be used in the conjunctive or disjunctive sense and will generally be understood to be equivalent to "and/or". Elements from an embodiment may be combined with elements of another. No element used in the description of this application should be construed as critical or essential to the invention unless explicitly described as such. Further, when an element is described as "connected," "coupled," or otherwise linked to another element, it may be directly linked to the other element, or intervening elements may be present.

According to exemplary embodiments of the invention, an improved jump rope handle and method of assembling the same are provided. In an embodiment, a jump rope handle may include a grip and a rotating head. The grip may include an assembly including a sleeve around a bushing through which a bolt may pass. Bearings may be arranged on the bolt on either side of the bushing and sleeve. The assembly may be secured inside the grip by virtue of the sleeve being fixedly attached to the inside of the grip. An end of the bolt may be attached to the head. The bolt may rotate within the bearings and the bushing enabling the head to rotate. Accordingly, an embodiment may provide a precision rotating jump rope handle with an improved assembly. Additionally, the head of the jump rope may include a bolt hole to receive the bolt, a channel perpendicular to the bolt hole, and a set screw hole in line with the bolt hole. A set screw may be screwed into the set screw hole to secure a rope within the channel. Accordingly, an embodiment may provide flexibility with respect to a length and a type of a rope of a jump rope.

Figure 9:
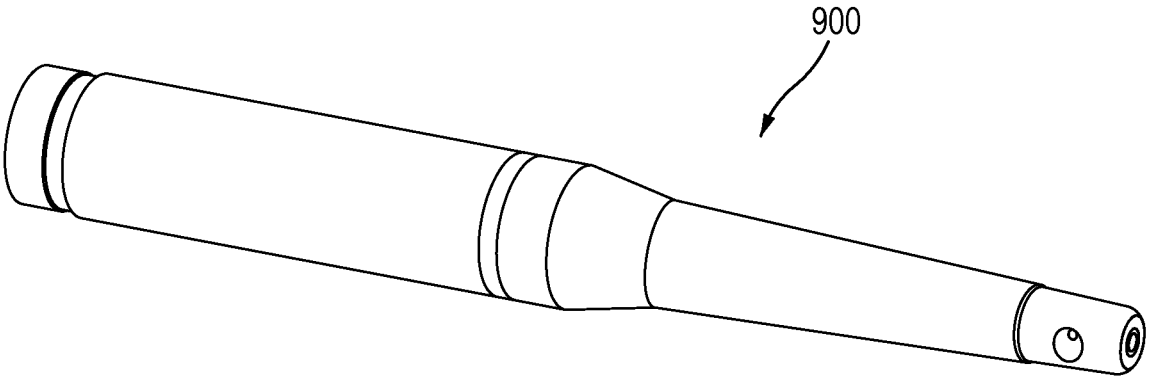
FIG. 9 is a schematic representation of a jump rope handle according to another exemplary embodiment of the invention.

FIG. 1 is a schematic representation of a jump rope handle 100 according to an exemplary embodiment of the invention. The jump rope handle 100 may include a grip 102 and a head 104, both arranged along axis A when assembled. The head 104 may rotate around axis A during use. The grip 102 and the head 104 may be formed of aluminum. In an alternative embodiment, the grip or the head may be formed of any suitable material, such as injection molded plastic. Although the jump rope handle is shown having a particular shape, the jump rope handle may have an alternative configuration such as that shown in the exemplary embodiment of FIG. 9.

Figure 2:
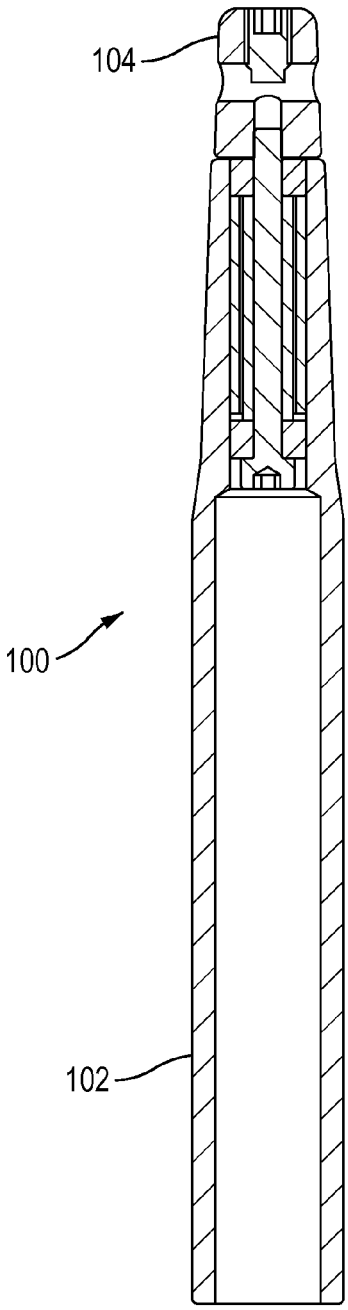
FIG. 2 is a schematic representation of a cutaway of the jump rope handle of FIG. 1.
Figure 3:
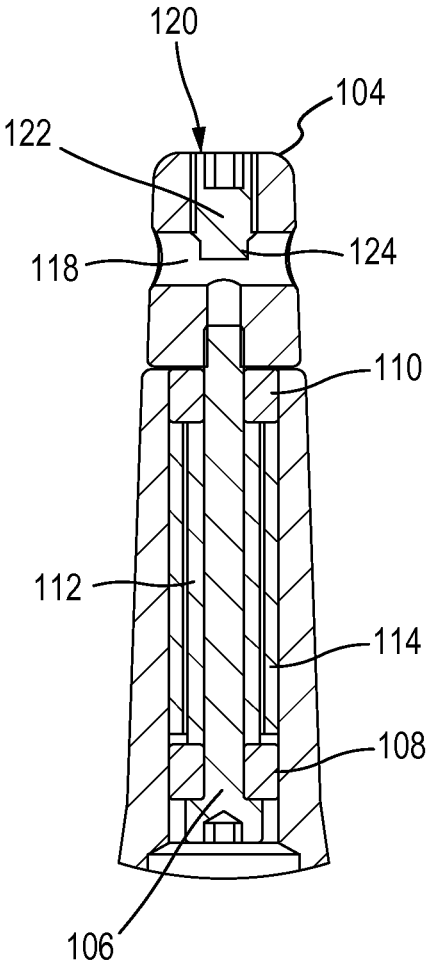
FIG. 3 is a schematic representation of a cutaway of a portion of the jump rope handle of FIG. 1.

FIG. 2 is a schematic representation of a cutaway of the jump rope handle 100 of FIG. 1. FIG. 3 is a schematic representation of a cutaway of a portion of the jump rope handle 100 of FIG. 1. The inside of the grip 102 may define a shaft that is hollow that may house a bolt 106, first and second bearings 108, 110, a inner bushing 112, and a sleeve 114. The bolt 106 may be formed of alloy steel. In an alternative embodiment, the bolt may be formed of any suitable material such as stainless steel. The first and second bearings 108, 110 may be formed of steel. In an alternative embodiment, the bolt may be formed of any suitable material such as stainless steel. The inner bushing 112 may be cylindrical and may be formed of brass. In an alternative embodiment, the inner bushing may be formed of any suitable material such as steel. The sleeve 114 may be cylindrical and may be formed of steel. In an alternative embodiment, the sleeve 114 may be formed of any suitable material.

The bolt 106 may be surrounded by the first and second bearings 108, 110 and the inner bushing 112. The inner bushing 112 may be located between the first and second bearings 108, 110. The sleeve 114 may be located around the inner bushing 112. An outer diameter of the sleeve 114 may be slightly larger than an inner diameter of the shaft of the grip 102 and may thereby provide an interference fit securing the bolt 106, the first and second bearings 108, 110, and the inner bushing 112 within the grip 102. A suitable adhesive material such as thread-lock glue may be added to an outer surface of the sleeve 114 and an inner surface of the grip 112. In operation, the sleeve 114 may remain stationary and not rotate due to the interference fit and the adhesive material. In an alternative embodiment such as one featuring an injection molded plastic grip, the sleeve may be formed integral with the grip. In a further alternative embodiment, the sleeve may be affixed to the grip using an interference fit. In a further alternative embodiment, an outer diameter of the sleeve may match or be slightly smaller than an inner diameter of the shaft of the grip and adhesive material may be used to affix the sleeve to the shaft of the grip.

Figure 4:
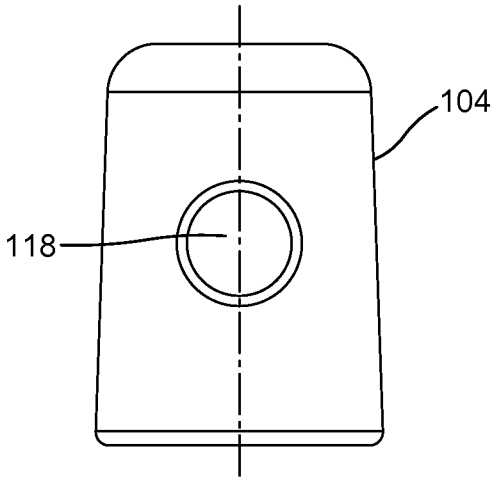
FIGS. 4-6 are schematic representations of the head of FIG. 1.
Figure 5:
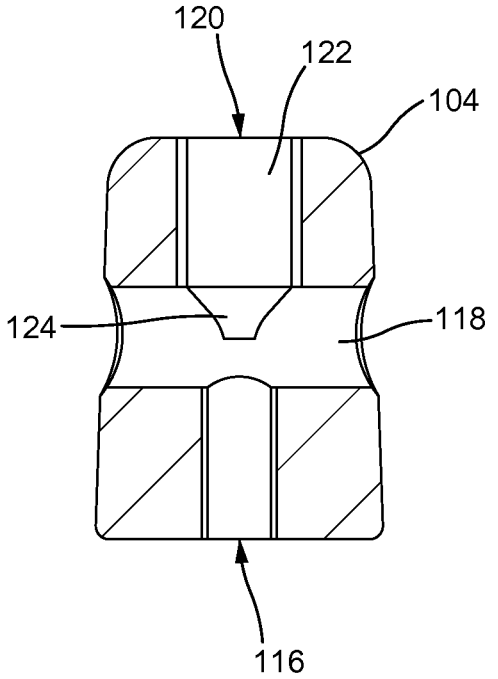
Figure 6:
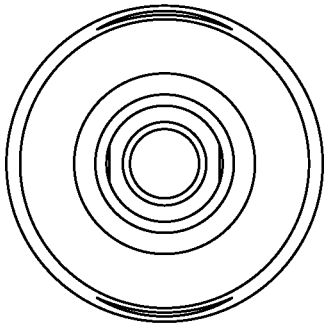

FIGS. 4-6 are schematic representations of the head 104 of FIG. 1. The head 104 may include a bolt hole 116, a channel 118, a set screw hole 120, and a set screw 122. The set screw 112 may be formed of alloy steel. In an alternative embodiment, the set screw may be formed of any suitable material such as stainless steel.

When assembled with the grip 102, the bolt hole 116 and the set screw hole 120 may each be in line with the handle axis A while the channel 118 may be perpendicular to the handle axis A. The head 104 may rotate about axis A during use while the channel 118 may remain perpendicular to the handle axis A during rotation of the head.

Figure 7:
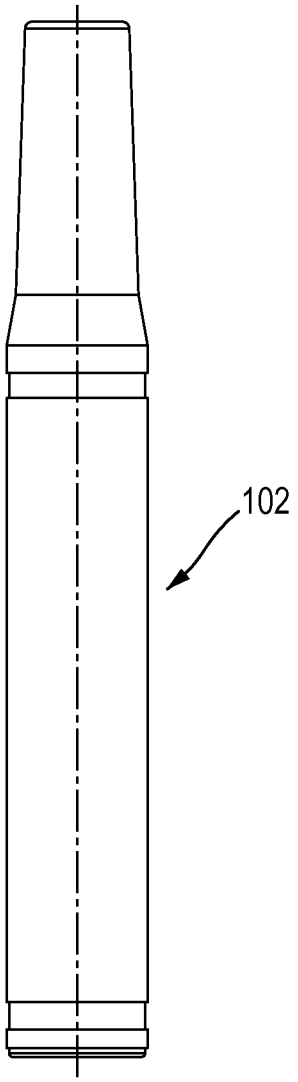
FIGS. 7 and 8 are schematic representations of the grip of FIG. 1.
Figure 8:
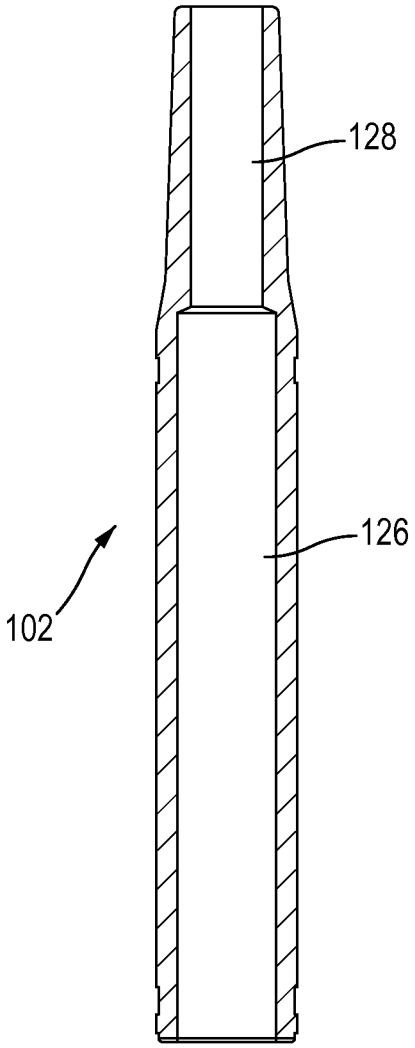

FIGS. 7 and 8 are schematic representations of the grip 102 of FIG. 1. The shaft of the grip 102 may include first and second portions 126, 128. The first portion 126 of the shaft may be larger in diameter than the second portion 128 of the shaft.

Referring now to FIGS. 3 and 5, the bolt hole 116 of the head 104 may receive an end of the bolt 106. The bolt 106 may be tightened thereby putting tension on the head 104. By tightening the bolt 106, the head 104 may thereby be pulled towards the grip 102 thereby sandwiching the first and second bearings 108, 110 and the inner bushing 112. A shim-washer 130 may be placed between the second bearing 110 and the head 104.

In more detail, the inner bushing 112 may be located between the first and second bearings 108, 110. The inner bushing 112 may be longer than the sleeve 114. The ends of the inner bushing 112 may contact only inner races of the first and second bearings 108, 110 and may prevent the first and second bearings from being over-tightened. When being assembled, the bolt 106 may be tightened until there is no play in the first and second bearings 108, 110 and not further so as to not reduce functionality of the first and second bearings 108, 110. A suitable adhesive material such as a thread-lock glue may be used to form a bond between threads of the bolt 106 and threads of the bolt hole 116 once the bolt 106 has been appropriately tightened.

An assembly of the bolt 106, the first and second bearings 108, 110, and the inner bushing 112 may be contained within the second portion 128 of the shaft of the grip 102 by the sleeve 114 and its attachment to the grip through the interference fit and adhesive or other attachment as already described. When assembled, a compression load may be held by the inner races of the first and second bearings 108, 110 and the inner bushing 112 by the bolt 106 to the head 104. Ends of the sleeve 114 may contact the outer races of the first and second bearings 108, 110. According to this construction, the first and second bearings 108, 110 may be isolated from the handle 102 and may spin freely during operation and not be bound.

Referring to FIG. 5, the set screw hole 120 may extend from an end of the head 104 through to the channel 118. The set screw 122 may be screwed into the set screw hole 120. A tip of the set screw 122 may insert into the channel 118 when the set screw 122 is screwed into the screw hole 120 thereby pressing against an end of a jump rope (not shown). Because the set screw 122 may be removable, a length of the jump rope may be adjustable for a user.

It should be noted that the jump rope handle 100 may be compatible with a variety of different jump rope shapes and materials. For example, a jump rope may be formed of a traditional rope, a metal chain, a beaded chain, a metal wire, or any other suitable material.

The set screw 122 may include an extended point 124 (or "dog point") that may clamp down on the jump rope. In an alternative embodiment, the set screw may include any suitable shape, such as a cone point, a round point, or a cup point, such as may be desirable based on the material of the jump rope.

Figure 10:
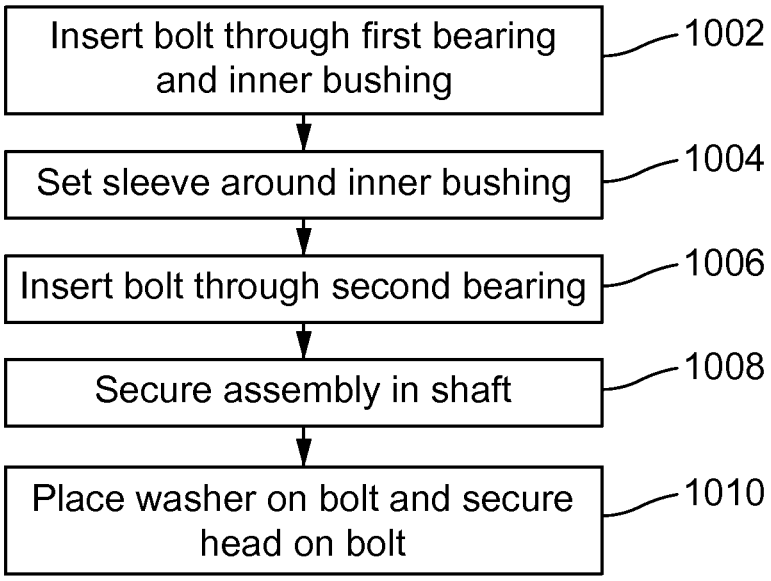
FIG. 10 is a schematic representation of a method of assembling the jump rope handle of FIG. 1.

FIG. 10 is a schematic representation of an exemplary method of assembling the jump rope handle 100 of FIG. 1. In one or a set of operations, the sleeve 114 may be secured inside of the shaft of the grip 102 of the rope handle. For example, in operation 1002, the bolt 106 may be inserted through the first bearing 108 and the inner bushing 112. In operation 1004, the sleeve 114 may be placed around the inner bushing 112. In operation 1006, the bolt 106 may be inserted through the second bearing 110, thereby completing the assembly of the bolt 106, first and second bearings 108, 112, the inner bushing 112, and the sleeve 114.

In operation 1008, the assembly of the bolt 106, first and second bearings 108, 110, the inner bushing 112, and the sleeve 114 may be inserted into the second portion 128 of the shaft of the grip 102. A suitable adhesive material may first be applied to the outer surface of the sleeve 114 and the inner surface of the second portion 128 of the shaft of the grip 112. The assembly of the bolt 106, first and second bearings 108, 110, the inner bushing 112, and the sleeve 114 may be secured in position by press-fitting the assembly of the bolt 106, first and second bearings 108, 110, the inner bushing 112, and the sleeve 114 into second portion 128 of the shaft of the grip 102, and by the adhesive. In an alternative embodiment including a sleeve having a matching or smaller diameter than the second portion 128 of the shaft, the assembly (bolt 106, first and second bearings 108, 110, inner bushing 112, and sleeve 114) may be secured in the second portion using an adhesive. The adhesive may cure thereby securing the sleeve 114 to the second portion of the shaft.

In another operation or set of operations, the bolt 106 may be connected to the head 104 of the jump rope handle 100. For example, in operation 1010, the shim-washer 130 may be placed on the bolt 106, and the head 104 may be connected to (i.e., screwed onto) the bolt 106. The bolt 106 may be tightened into the bolt hole 116 thereby pulling the head 104 towards the grip 102 thereby sandwiching the first and second bearings 108, 110 and the inner bushing 112. Adhesive may be used to secure the bolt in the bolt hole 116.

According to embodiments of the invention, a precision rotating jump rope handle may be provided with an improved assembly. The manufacture and the assembly of the jump rope handle may be desirable. Further according to the embodiments, flexibility with respect to a length and a type of a rope of a jump rope may be provided. The length may be customized to a user. The type of rope used with the jump rope handle may vary.

Although embodiments of the present invention have been shown and described, it would be appreciated by those skilled in the art that changes may be made in these embodiments without departing from the principles and spirit of the invention, the scope of which is defined in the claims and their equivalents. For example, operations of the method for assembling a jump rope handle may be performed in a different order. For example, an inner bushing may first be inserted into the sleeve 114 and then the bolt 106 may be inserted through the first bearing 108 and the inner bushing 112 having the sleeve 114 thereon. As a further alternative, during the assembly of the jump rope handle 100, the sleeve 114 may first be inserted into the second portion 128 of the shaft of the handle and fixed in position with adhesive. Thereafter, the bolt 106 and first bearing 108 may be inserted through the first portion 126 of the shaft into the second portion 128 and the inner bushing 112 and second bearing 110 could be inserted into the second portion 128 of the shaft. These and other changes are considered to be within the scope of the invention.

What is claimed is:

1. A jump rope handle, comprising:

a head, including:

a channel;

a set hole perpendicular to the channel; and a set mechanism adjustably insertable into the set hole;

a grip, including:

a cylindrical member axially spaced apart from an inner surface of the grip;

first and second bearings arranged along the cylindrical member, the bearings having an inner race and an outer race, with the inner races extending about the cylindrical member and with the outer races axially spaced apart therefrom;

an inner bushing extending around the cylindrical member between the inner race of each of the first and second bearings and spaced apart from the inner surface of the grip with the inner bushing being independently movable relative to the inner surface of the grip; and a sleeve extending around said inner bushing, said sleeve having an outer diameter originally larger than a diameter of the inner surface of the grip, said sleeve being fixedly attached to the inner surface of the grip by a compression fit resulting from press-fitting the cylindrical member, the first and second bearings, the inner bushing, and the sleeve into the grip, and the sleeve being interfaceable with the outer race of each of the first and second bearings, wherein an end portion of the cylindrical member is fixedly attached to the head whereby the cylindrical member and the head rotate together about a same axis, wherein the channel of the head is configured to receive a rope, and wherein the set mechanism is configured to be inserted into the set hole to secure the rope.

2. The jump rope handle of claim 1, wherein the sleeve is fixedly attached to the inner surface of the grip by adhesive.

3. The jump rope handle of claim 1, wherein the end portion of the cylindrical member is fixedly attached to the head by adhesive.

4. The jump rope handle of claim 1 wherein the sleeve has an upper end and a lower end, and the inner bushing has an upper end and a lower end, the upper end of the sleeve and the upper end of the inner bushing align with each other, with the lower end of the sleeve being spaced apart from the lower end of the inner bushing.

5. A jump rope handle, comprising:

a head, including:

a bolt hole;

a channel perpendicular to the bolt hole;

a set screw hole in line with the bole hole and perpendicular to the channel; and a set screw adjustably screwed into the set screw hole;

a grip including a shaft therein axially spaced apart from an inner surface of the grip, the shaft including:

a bolt;

first and second bearings arranged along the bold, the bearings having an inner race and an outer race, with the inner races extending about the bolt and the outer races being axially spaced apart therefrom;

an inner busing extending around the bolt between the inner race of each of the first and second bearings and spaced apart from the inner surface of the grip; and a sleeve extending around said inner bushing, said sleeve having an outer diameter originally larger than a diameter of the inner surface of the shaft of the grip, an outer surface of the sleeve being fixedly attached to the inner surface of the shaft of the grip by a compression fit resulting from press-fitting the bolt, the first and second bearings, the inner bushing, and the sleeve into the shaft of the grip, and the sleeve being interfaceable with the outer race of each of the first and second bearings with the inner bushing being independently movable relative to the inner surface of the grip, wherein a threaded end of the bolt is screwed into the bolt hold of the head and attached thereto whereby the bolt and the head rotate together about a same axis, wherein the channel of the head is configured to receive a rope, and wherein the set screw is configured to be screwed into the set screw hole to secure the rope.

6. The jump rope handle of claim 5, wherein the sleeve is fixedly attached to the inner surface of the shaft of the grip by adhesive.

7. The jump rope handle of claim 5, wherein the threaded end of the bolt is fixedly attached to the bolt hole of the head by adhesive.

8. The jump rope handle of claim 5 wherein the sleeve has an upper end and a lower end, and the inner bushing has an upper end and a lower end, the upper end of the sleeve and the upper end of the inner bushing align with each other, with the lower end of the sleeve being spaced apart from the lower end of the inner bushing.

* * * * *